US009460577B2

(12) United States Patent
Kim

(10) Patent No.: US 9,460,577 B2
(45) Date of Patent: Oct. 4, 2016

(54) SHARING A KEY FOR A VEHICLE

(71) Applicant: Hyundai Motor Company, Seoul (KR)

(72) Inventor: Dong Uk Kim, Incheon (KR)

(73) Assignee: Hyundai Motor Company, Seoul (KR)

( * ) Notice: Subject to any disclaimer, the term of this patent is extended or adjusted under 35 U.S.C. 154(b) by 49 days.

(21) Appl. No.: 14/557,178

(22) Filed: Dec. 1, 2014

(65) Prior Publication Data

US 2016/0019738 A1 Jan. 21, 2016

(30) Foreign Application Priority Data

Jul. 17, 2014 (KR) ..... 10-2014-0090553

(51) Int. Cl.
*G07C 9/00* (2006.01)

(52) U.S. Cl.
CPC ..... *G07C 9/00182* (2013.01); *G07C 9/00174* (2013.01); *G07C 9/00817* (2013.01); *G07C 2009/00238* (2013.01); *G07C 2009/00777* (2013.01); *G07C 2009/00793* (2013.01); *G07C 2009/00825* (2013.01); *G07C 2209/04* (2013.01)

(58) Field of Classification Search
CPC ..... G07C 9/00182; G07C 9/00309; G07C 9/00817; G07C 2009/00793; G07C 2009/00928; G07C 9/00857; G07C 9/00103
USPC ..... 340/5.22
See application file for complete search history.

(56) References Cited

U.S. PATENT DOCUMENTS

| | | | | |
|---|---|---|---|---|
| 8,943,187 | B1 * | 1/2015 | Saylor | H04L 67/306 709/223 |
| 2007/0001805 | A1 * | 1/2007 | Utter | B60R 25/24 340/5.72 |
| 2013/0166106 | A1 * | 6/2013 | Nakagawa | G06F 17/00 701/2 |
| 2013/0301829 | A1 * | 11/2013 | Kawamura | H04L 9/0816 380/44 |
| 2013/0321140 | A1 * | 12/2013 | Kumagai | B60C 23/0479 340/447 |
| 2014/0223177 | A1 * | 8/2014 | Dempster | G06F 21/6245 713/165 |
| 2014/0232524 | A1 * | 8/2014 | Nakai | B60R 25/24 340/5.61 |
| 2014/0371875 | A1 * | 12/2014 | Boye | G05B 15/02 700/9 |
| 2016/0001743 | A1 * | 1/2016 | Okada | B60R 25/406 701/2 |

FOREIGN PATENT DOCUMENTS

| | | | |
|---|---|---|---|
| JP | 2010-126949 | A | 6/2010 |
| KR | 10-2005-0089272 | A | 9/2005 |
| KR | 10-2007-0010536 | A | 1/2007 |
| KR | 10-2012-0116924 | A | 10/2012 |
| KR | 10-2013-0047915 | A | 5/2013 |
| KR | 10-2014-0022490 | A | 2/2014 |

* cited by examiner

*Primary Examiner* — Mark Blouin
(74) *Attorney, Agent, or Firm* — Mintz Levin Cohn Ferris Glovsky and Popeo, P.C.; Peter F. Corless

(57) ABSTRACT

A method for sharing a key of a vehicle that electronically controls the vehicle includes: setting a control value limiting a use of the vehicle through a terminal of a user of the vehicle which includes the key of the vehicle, and transferring the key of the vehicle from the terminal of the user to a terminal of an additional user of the vehicle using short-distance communication.

11 Claims, 3 Drawing Sheets

SHARING A KEY FOR A VEHICLE

CROSS-REFERENCE TO RELATED APPLICATION

This application claims the benefit of and priority to Korean Patent Application No. 10-2014-0090553, filed on Jul. 17, 2014 in the Korean Intellectual Property Office, the disclosure of which is incorporated herein in its entirety by reference.

TECHNICAL FIELD

The present disclosure relates to a method for sharing a key for a vehicle, and more particularly, to a method for sharing a vehicle key with an additional user of the vehicle using short-distance communication.

BACKGROUND

Recently, electronic keys for a vehicle stored in a portable terminal, such as a mobile phone, have been used for opening or closing a door of the vehicle or for ignition of an engine. Electronic keys allow a vehicle door to be automatically opened or closed or allow an engine to be started, provided that the corresponding identification (ID) codes are matched with each other by transmitting ID code, or the like, to a device mounted in the vehicle and comparing the transmitted ID code with the ID code stored in the vehicle.

In addition, the electronic vehicle keys can be shared in a scheme utilizing a separate server, for example, in order to share the electronic key with an additional user trying to use the vehicle. As a result, server operation and sharer authentication processes are necessarily performed.

SUMMARY

The present disclosure has been made to solve the above-mentioned problems occurring in the related art while advantages achieved by the related art are maintained intact. An aspect of the present disclosure provides a method for sharing a key of a vehicle capable of setting a condition required by a user of the vehicle without a separate server interworking and directly sharing the key of the vehicle with an additional user using short-distance communication.

According to embodiments of the present disclosure, a method for sharing a key of a vehicle that electronically controls the vehicle includes: setting a control value limiting a use of the vehicle through a terminal of a user of the vehicle which includes the key of the vehicle; and transferring the key of the vehicle from the terminal of the user to a terminal of an additional user of the vehicle using short-distance communication.

The short-distance communication may be a near field communication (NFC)-based communication technique in which the key of the vehicle is transferred to the terminal of the additional user by a direct tag between the terminals.

The control value limiting the use of the vehicle may limit at least one of: a usable period, a usable time, a usable region, and a usable range of the vehicle, and the usable range may relate to an opening or a closing of a door of the vehicle or an ignition of the vehicle.

The key of the vehicle may electronically control the vehicle through a tagging of an NFC tag included in the vehicle.

The method may further include, by the terminal of the additional user, requesting the terminal of the user of the vehicle to change the control value limiting the use of the vehicle.

The method may further include, in a case in which the use of the vehicle does not correspond to the control value limiting the use of the vehicle, informing, by the terminal of the additional user, the terminal of the user that the use of the vehicle does not correspond to the control value.

The terminal of the additional user may inform the terminal of the user that the use of the vehicle does not correspond to the control value through mobile communication serving the terminals.

In a case in which the user remotely transfers information related to the use of the vehicle to the additional user, the information may be additionally transferred to the additional user through mobile communication serving the terminals.

The additional user may be one of at least one additional user, and in a case in which the additional user is one of a plurality of additional users, the control value may be respectively set for each of the plurality of additional users or a same control value may be set for all of the plurality of additional users.

The terminal of the user and the terminal of the additional user may include a dedicated application for sharing the key of the vehicle, and the control value may be set or the key of the vehicle may be transferred through the dedicated application.

Further, an apparatus for sharing a key of a vehicle that electronically controls the vehicle includes: a terminal of a user of the vehicle including the key of the vehicle and being configured to: set a control value limiting a use of the vehicle, and transfer the key of the vehicle from the terminal of the user to a terminal of an additional user of the vehicle using short-distance communication.

Even further, a non-transitory computer readable medium containing program instructions for sharing a key of a vehicle that electronically controls the vehicle includes: program instructions that set a control value limiting a use of the vehicle through a terminal of a user of the vehicle which includes the key of the vehicle, and program instructions that transfer the key of the vehicle from the terminal of the user to a terminal of an additional user of the vehicle using short-distance communication.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
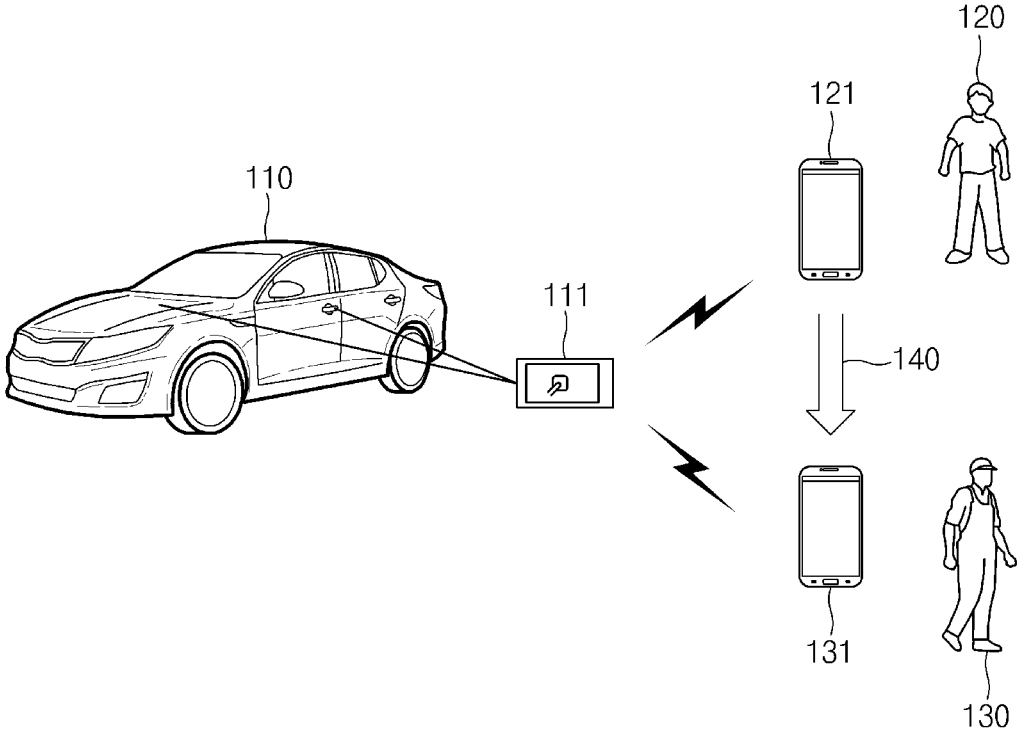
FIG. 1 is a view schematically illustrating a method for sharing a key of a vehicle according to embodiments of the present disclosure.

Advantages and features of the present disclosure and methods to achieve them will be described from embodiments described below in detail with reference to the accompanying drawings. However, the present disclosure is not limited to the embodiments set forth herein, but may be modified in many different forms. Merely, the embodiments of the present disclosure will be provided to describe in detail so that those skilled in the art may easily implement the spirit of the present disclosure.

In the drawings, the embodiments of the present disclosure are not limited to specific forms, but are exaggerated for clarity. In the present specification, specific terms have been used, but are just used for the purpose of describing the present disclosure and are not used for qualifying the meaning or limiting the scope of the present disclosure, which is disclosed in the appended claims.

In the present specification, an expression 'and/or' is used as a meaning including at least one of components listed before and after the expression. In addition, an expression 'connected to or coupled to' is used as a meaning including a case in which one component is directly connected to another component or is indirectly connected through another component. Unless explicitly described to the contrary, a singular form includes a plural form in the present specification. In addition, components, steps, operations, and/or elements mentioned by 'comprise' or 'comprising' used in the present specification mean the existence or addition of one or more other components, steps, operations, and/or elements.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

Additionally, it is understood that the below methods may be executed by at least one terminal. The term "terminal" refers to a hardware device that may include a memory and a processor. The memory may be configured to store program instructions, and the processor may be configured to execute the program instructions to perform one or more processes which are described further below.

Furthermore, the terminal of the present disclosure may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

Hereinafter, embodiments of the present disclosure will be described in detail with reference to the accompanying drawings.

As an example, potential user(s) of a vehicle may be together with the owner of the vehicle. In a case in which the user(s) around the owner of the vehicle want to additionally use the vehicle, a physical key for the vehicle capable of opening or closing a door of the vehicle or starting the vehicle is generally transferred to one of the users (i.e., an "additional user"). In addition, in a case in which the key for the vehicle is an electronic key that electronically controls the vehicle, the electronic key can be transferred to the additional user, e.g., through a server operated by a manufacturing company of the vehicle, or the like.

However, in a case in which the electronic key is transferred to the additional user through a separate server, the electronic key may be unintentionally transferred to others, e.g., due to hacking of the corresponding server or a mistake of an operator. Consequently, while the electronic key may control the vehicle in a convenient and useful way, it must be safe to directly transfer the key for the vehicle to the additional user(s).

The present disclosure allows the user of a vehicle to transfer an electronic key for electronically controlling the vehicle to an additional user(s) of the vehicle, thereby making it possible to safely share the key.

FIG. 1 is a view schematically illustrating a method for sharing a key for a vehicle according to embodiments of the present disclosure.

Referring to FIG. 1, in the method for sharing the key for the vehicle according to embodiments of the present disclosure, an electronic key for a vehicle (hereinafter, referred to as "a key for a vehicle") capable of opening or closing a door or starting the vehicle by controlling a vehicle 110 in an electronic way (111) may be transferred (140) from a terminal 121 of a user 120 of the vehicle to a terminal 131 of an additional user 130 of the vehicle using short-distance communication connected between the terminals 121 and 131.

Here, the short-distance communication connected between the terminals 121 and 131 may utilize a near field communication (NFC)-based communication technique employed by the terminals 121 and 131, and the NFC communication may be formed through an application (hereinafter, referred to as "a dedicated application") executed on the terminals 121 and 131. In a case in which the terminals 121 and 131 are connected to each other by the NFC communication technique, the electronic key for the vehicle may be transferred (140) to the terminal 131 of the additional user 130 through a process in which the user 120 of the vehicle directly tags his or her own terminal 121 to the terminal 131 of the additional terminal 130.

Consequently, since the electronic key for the vehicle does not utilize a separate server or the like, the user of the vehicle may safely share the key for the vehicle with the additional user(s) without burden of a server operation. In addition, the above-mentioned key for the vehicle may electronically control the vehicle through the tagging with an NFC tag module included in the vehicle.

Figure 2:
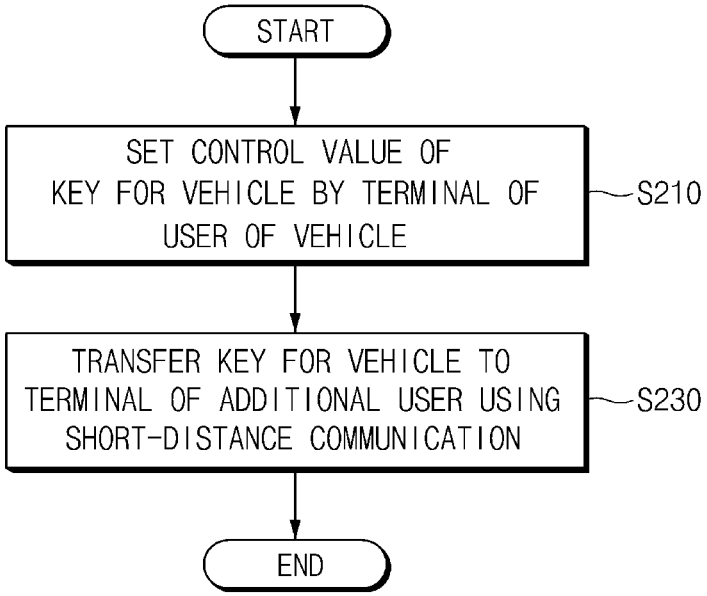
FIG. 2 is a view illustrating the method for sharing the key of the vehicle according to embodiments of the present disclosure.

FIG. 2 is a view illustrating the method for sharing the key for the vehicle according to embodiments of the present disclosure.

First, the user of the vehicle may use the key to drive the vehicle (e.g., start the ignition) by electronically controlling the vehicle through his or her terminal. The driving of the vehicle using the electronic key may be implemented by a function included in the terminal or may be implemented by the dedicated application included in and executed on the terminal of the user of the vehicle. Here, the dedicated application may be installed in the terminal of the user in advance and may be downloaded via a web to be installed, as an example.

The electronic key for the vehicle used in the present disclosure may not only cause the door to open or close or the engine to start, which is a function of a typical physical key for vehicle, but also perform additional control of the vehicle, such as allowing the user to directly set or control a control value corresponding to the control of the vehicle through the terminal of the user of the vehicle.

To this end, the control value, as set by the user, is capable of limiting a use for each type of vehicle control (as listed above) through the user's terminal before transferring the key to the additional user (S210). Then, the additional user may receive the key for the vehicle, after having the control value for the key being set, from the terminal of the user. The receiving and usage of the key for the vehicle may be implemented by a function included in the terminal or may be implemented by the dedicated application included in and executed on the terminal of the additional user. Here, it may be preferable that the dedicated application which is executed is the same application as the dedicated application executed on the terminal of the user of the vehicle, but it may be a dedicated application having a specialized receiving function. The key for the vehicle having the control value set in S210 by the terminal of the user of the vehicle is then transferred to the terminal of the additional user (S230).

Figure 3:
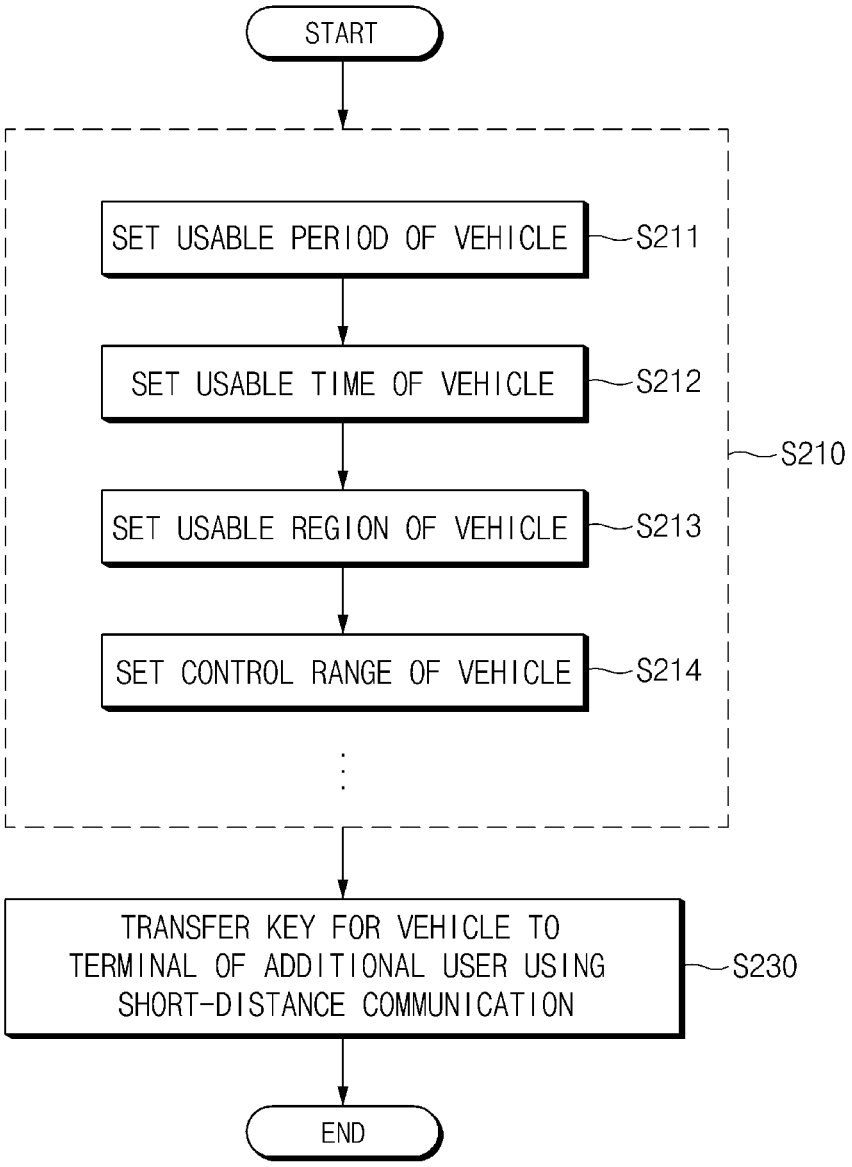
FIG. 3 is a view illustrating a setting limiting a use of the vehicle in the method for sharing the key of the vehicle according to embodiments of the present disclosure.

FIG. 3 is a view illustrating a setting limiting a use of the vehicle in the method for sharing the key for the vehicle according to embodiments of the present disclosure.

Hereinafter, the control value limiting the use of the vehicle in S210 will be described in detail with reference to FIG. 3. As described above, the electronic key for the vehicle may limit the use of the vehicle according to the setting of the user of the vehicle. Specifically, a period in which the additional user may use the vehicle may be set (S211). For example, the user of the vehicle may set a period in which the key to be shared may open or close the door of the corresponding vehicle or start the vehicle as one unit through his or her terminal. Then, the additional user using the transferred key having the period set to the control value may use the vehicle only for the corresponding period.

In addition, a time in which the additional user may use the vehicle may be set (S212). For example, in a case in which the user of the vehicle is a parent and the additional user is grown-up children, in order to prevent the use of the vehicle late at night, the time during which the key that is transferred may open or close the vehicle doors or start the vehicle can be limited to a range from 7 A.M. to 10 P.M.

In addition, a vehicle usable region may be set (S213). For example, the above-mentioned control value can prevent the use of the vehicle by the additional user beyond the intended use of the vehicle, as defined by the user, thereby making it possible to prevent an occurrence of driving in a crime-ridden district or long-distance driving which is not desired by the user.

In addition, a vehicle usable range may also be set (S214). For example, the additional user may share a key capable of opening or closing only a vehicle door only, such that a surrounding person who does not have a driver's license can receive the key for the vehicle, in order to open or close the vehicle doors without being able to drive the vehicle. This may be applicable to minors, for example.

In addition, the additional user sharing the key for the vehicle may request a change for the item in which the use of the vehicle is limited according to the control value set in the key for the vehicle shared with the additional user. Specifically, in the case in which the additional user capable of opening or closing only the door obtains the driver's license or wants to additionally extend the period when the set usable period lapses, the additional user may request the change of the corresponding control value through his or her terminal in addition to directly querying the user of the vehicle.

In a case in which the key for the vehicle is used beyond the range limiting the use of the vehicle set in S210, for example, there may be a case in which the opening or closing of the door of the vehicle and the starting of the vehicle are performed in an allowed period of time, but the vehicle is continuously driven during a period of time in which the driving of the corresponding vehicle is not allowed. In this case, the user of the vehicle sharing the key may be informed of the state which does not match a limiting value limiting the use of the vehicle through the terminal of the additional user. Thereby, the user of the vehicle sharing the key may recognize whether or not the vehicle is driven outside of the limit set by the user of the vehicle in real-time. This notification may be transferred to the user of the vehicle through a mobile communication service (e.g., a short message service (SMS), a data messenger, or the like) serving the terminal.

In addition, in a case in which information related to the driving of the vehicle needs to be transferred to the additional user of the vehicle, the corresponding information may be transferred in real-time to the additional user through the dedicated application executed to share the key for the vehicle or may be transferred in real time to the additional user through mobile communication serving the terminals. In addition, there may be one additional user or a plurality of additional users. Particularly, in the case in which the additional user is the plural, the user of the vehicle may share the key for the vehicle with each additional user by setting each control value for each additional user. That is, the use of the vehicle may be limited according to individual characteristic of the additional user. Of course, the key for the vehicle may be shared by setting the same control value for all of the plurality of additional users, as well.

As a result, in the method for sharing the key for the vehicle according to embodiments of the present disclosure, since the user of the vehicle may directly share the key that electronically controls the vehicle with the additional user(s) and may directly set the limit(s) related to the use of the vehicle for each mode of controlling the vehicle, it may safely transfer the key to the additional user(s), unlike sharing the electronic key through a separate server and the like, as in the related art. As described above, according to embodiments of the present disclosure, the method for sharing the key for the vehicle may set the condition required by the user of the vehicle without the separate server interworking and directly share the key for the vehicle with the additional user(s) using short-distance communication.

Hereinabove, although the present disclosure has been described with reference to embodiments thereof, those skilled in the art will appreciate that various modifications, additions and substitutions of the present disclosure are possible without departing from the scope and spirit of the present disclosure. Accordingly, the scope of the present disclosure is not construed as being limited to the described embodiments but is defined by the appended claims as well as equivalents thereto. Considering the contents as described above, if modifications and alterations of the present disclosure are included in the following claims and a scope equivalent thereto, it is considered that the present disclosure includes these modifications and alterations thereof.

What is claimed is:

1. A method for sharing a key of a vehicle that electronically controls the vehicle, the method comprising:

setting a control value limiting a use of the vehicle through a terminal of a user of the vehicle which includes the key of the vehicle; and transferring the key of the vehicle from the terminal of the user to a terminal of an additional user of the vehicle using short-distance communication, wherein the terminal of the additional user requests the terminal of the user to change or update the control value limiting the use of the vehicle.

2. The method according to claim 1, wherein the short-distance communication is a near field communication (NFC)-based communication technique in which the key of the vehicle is transferred to the terminal of the additional user by a direct tag between the terminals.

3. The method according to claim 1, wherein the control value limiting the use of the vehicle limits at least one of: a usable period, a usable time, a usable region, and a usable range of the vehicle, the usable range relating to an opening or a closing of a door of the vehicle or an ignition of the vehicle.

4. The method according to claim 1, wherein the key of the vehicle electronically controls the vehicle through a tagging of an NFC tag included in the vehicle.

5. The method according to claim 1, further comprising, in a case in which the use of the vehicle does not correspond to the control value limiting the use of the vehicle, informing, by the terminal of the additional user, the terminal of the user that the use of the vehicle does not correspond to the control value.

6. The method according to claim 5, wherein the terminal of the additional user informs the terminal of the user that the use of the vehicle does not correspond to the control value through mobile communication serving the terminals.

7. The method according to claim 1, wherein in a case in which the user remotely transfers information related to the use of the vehicle to the additional user, the information is periodically transferred to the additional user through mobile communication serving the terminals.

8. The method according to claim 1, wherein the additional user is one of at least one additional user, and in a case in which the additional user is one of a plurality of additional users, the control value is respectively set for each of the plurality of additional users or a same control value is set for all of the plurality of additional users.

9. The method according to claim 1, wherein the terminal of the user and the terminal of the additional user include a dedicated application for sharing the key of the vehicle, and the control value is set or the key of the vehicle is transferred through the dedicated application.

10. An apparatus for sharing a key of a vehicle that electronically controls the vehicle, the apparatus comprising:

a terminal of a user of the vehicle including the key of the vehicle and being configured to:

set a control value limiting a use of the vehicle, and transfer the key of the vehicle from the terminal of the user to a terminal of an additional user of the vehicle using short-distance communication, wherein the terminal of the additional user requests the terminal of the user to change or update the control value limiting the use of the vehicle.

11. A non-transitory computer readable medium containing program instructions for sharing a key of a vehicle that electronically controls the vehicle, the computer readable medium comprising:

program instructions that set a control value limiting a use of the vehicle through a terminal of a user of the vehicle which includes the key of the vehicle; and program instructions that transfer the key of the vehicle from the terminal of the user to a terminal of an additional user of the vehicle using short-distance communication, wherein the terminal of the additional user requests the terminal of the user to change or update the control value limiting the use of the vehicle.

* * * * *